United States Patent [19]

Knoos

[11] 4,327,657

[45] May 4, 1982

[54] SAILING CRAFT SELF-STEERING SYSTEM

[76] Inventor: Stellan P. Knoos, 5933 Avenida Chamnez, La Jolla, Calif. 92037

[21] Appl. No.: 115,735

[22] Filed: Jan. 28, 1980

Related U.S. Application Data

[63] Continuation-in-part of Ser. No. 959,326, Nov. 9, 1978, abandoned.

[51] Int. Cl.[3] ..... B63H 25/00

[52] U.S. Cl. ..... 114/144 C; 114/162; 114/128

[58] Field of Search ..... 114/144 R, 144 C, 162, 114/167, 128

[56] References Cited

U.S. PATENT DOCUMENTS

| | | | |
|---|---|---|---|
| 3,903,828 | 9/1975 | Green | 114/144 C |
| 3,983,831 | 10/1976 | Knoos et al. | 114/144 C |
| 3,990,385 | 11/1976 | Adams | 114/144 C |
| 4,078,511 | 3/1978 | Daniels | 114/144 C |
| 4,091,758 | 5/1978 | Rosen | 114/144 C |

FOREIGN PATENT DOCUMENTS

| | | | |
|---|---|---|---|
| 2658333 | 6/1978 | Fed. Rep. of Germany | 114/144 C |

OTHER PUBLICATIONS

Gererd Ratcliffe, "Vane Self-Steerers for Cruising Yachts", 1/18/75, S.N. AME.

Auto-Helmsman for Yachts", Eric Twiname, 2/26-3/5/71, Engineering, vol. 210 #5464.

Dijkstra, "Self Steering", 1979, Sail Books, Inc., pp. 18, 19, FIG. 1.11.

*Primary Examiner*—Trygve M. Blix
*Assistant Examiner*—D. W. Keen
*Attorney, Agent, or Firm*—Edward A. Sokolski

[57] ABSTRACT

A self-steering system particularly suitable for maintaining a sailing craft such as a yacht on a preselected heading relative to the apparent wind. An oar member which forms a hydrodynamic servo is mounted on a center body for rotational motion. Also supported on the center body above the oar member is a wind vane which is mounted for rotational adjustment and for pivotal motion substantially normal to its rotational axis. The center body is pivotally supported on the transom of the yacht for motion about an axis approximately parallel to the longitudinal center line of the boat. The wind vane is coupled to the oar member such that when the heading of the yacht changes relative to the apparent wind, the wind vane is pivotally driven sidewise by the wind and through its linkage thereto rotatably drives the oar member. Such rotatable motion of the oar member from a predetermined neutral position results in sidewise water forces thereon which pendulously drive the oar member sidewise and along with it rotate the center body and the vane base. The center body is coupled through a suitable linkage to the steering control of the yacht such that the sidewise pendulous motion of the oar causes the steering control to drive the rudder of the yacht in a direction such as to maintain the yacht on the preselected heading relative to apparent wind.

20 Claims, 18 Drawing Figures

100
77
88
40
74
72
70
74
88
100
77
83
82
80
80a
134
118
120

107
107b
132
108b
105
126
108
108a
110
130
83
82
82
128
107a
108
115
124
114
119
119
116
117
118
108
107

SAILING CRAFT SELF-STEERING SYSTEM

This application is a continuation-in-part of my Application Ser. No. 959,326, filed Nov. 9, 1978, now abandoned.

This invention relates to self-steering systems for sailing craft, and more particularly to such a system which employs a rotatably and pendulously supported oar member which is suspended in the water stream behind the craft and which is employed to control the steering mechanism of the craft in response to a mechanism such as a wind vane which senses changes in boat heading from a preselected heading.

A self-steering system for a sailing craft is described in my U.S. Pat. No. 3,983,831, issued Oct. 5, 1976, which is hereby incorporated into the present application by reference. The system described in this patent employs a wind vane which senses changes in craft heading relative to apparent wind and in response thereto rotatably drives a pendulously and rotatably supported oar member in the same general manner as the system of the present invention. In the system described in my prior patent, however, an auxiliary rudder member, rather than the regular boat rudder, is driven by the pendulous oar and used to control the steering of the boat to maintain the desired heading relative to apparent wind. This prior art system, while it has been quite successful in the field, both from the point of view of reliability and performance, has been found to be somewhat expensive for use in smaller yachts and boats and situations where only part-time self-steering or moderate performance is desired. The system of the present invention is a simpler, more economical self-steering system than in my prior art invention which rather than employing a separate auxiliary rudder connects to the steering of the yacht or a boat to effect steering control mainly through the regular boat rudder.

In my prior art patent, there is a rather thorough discussion of the prior art which is probably so far best described in a book by John S. Letcher, Jr., published in 1974 by International Marine Publishing Company in Camden, Maine, entitled "Self-Steering for Sailing Craft", although this book does not completely describe some of the newer systems. A more recent book describing some of the newer systems is "Self-Steering for Sailboats" by Gerard Dykstra, published in 1979 by Sail Books Inc., Boston Mass. In view of the incorporation of my prior patent into the present application by reference, this prior art material will be discussed herein, but briefly. One particular system described in Letcher's book which is closer in its features than any of the other such systems, and therefore will be particularly mentioned herein, is the original system developed by H. G. Hasler (and followed by others, such as the Aries and Atoms commercially available systems). This system employs an air-foil shaped oar placed in the water which is rotated in response to a wind vane and with a support which is fixedly mounted on the yacht transom. This blade is pendulously driven by the water stream when so rotated, such pendulous motion being employed to drive the tiller of the boat to steer the yacht through the main rudder. The Hasler system (and its followers Aries, Atoms, Navik, etc.), while having a few general features somewhat akin to that of the present invention, has a substantially different construction and implementation that requires a somewhat cumbersome rudder coupling mechanism involving a special installation; (it is an important difference that the present invention employs a vane mast tube which undergoes a pendulous motion with the oar). Further, it is not portable in nature nor is it suitable for rapid installation and removal as would be desired where operation either with or without the device is contemplated. Further, the Hasler type system is somewhat more complicated and expensive, as well as mechanically weaker in its construction than the system of the present invention which obviates its use in applications where economy, mechanical simplicity and strength are of prime importance.

The system of the present invention provides the following advantages over the prior art. First, as already emphasized, it has great mechanical simplicity and employs a minimum number of components, and thus is of relatively low cost as compared with most prior art systems. In addition, the use of lesser parts contributes to higher reliability and lower weight. Further, the system is constructed so that it can easily be disconnected and reinstalled on the transom, even at sea, in view of the simple bracket support mechanism employed. Further, the system of the present invention can readily be partially disconnected from the transom and the steering lines at sea to permit plus or minus 90° swing of the oar to avoid breakage of the oar in heavy seas. Special emergency break points are provided in the coupling lines of the tiller so that in an emergency heavy sea situation, only the lines will break, permitting the oar sufficient freedom so as to avoid breakage of the oar or other basic parts of the system. As already noted, the system can be removed from the transom and can be stowed on the yacht when its use is not desired. Other special features provided in the present system include means for adjusting the vane/oar ratio and means for trimming the control lines relative to the tiller to adjust for the helm.

Briefly described, the system of my invention is as follows: an oar member which is placed in the water stream is rotatably mounted on a center body. This center body is pivotally mounted on the transom of a boat to provide pendulous motion of the oar member relative thereto. Also supported on the center body for sidewise pivotal motion and rotational positioning is a wind vane. The wind vane is connected through a push rod mechanism to the oar member such that sidewise pivotal motion of the vane results in rotational motion of the oar in a predetermined relationship. The oar and wind vane are joined together by the center body to form a unitary assembly which is pivotally supported through the center body on the transom of the boat such that pendulous motion of the oar in response to the water stream results in pivotal motion of the assembly. The wind vane and the oar are joined together by the center body so that the wind vane moves laterally and the center body moves pivotally with pendulous motion of the oar, the center body being pivotally attached to the transom. Means are provided to connect the center body of the assembly to the tiller of the yacht such that pivotal motion of the center body will result in motion of the tiller which will rotate the rudder of the yacht (in the same direction as the oar was rotated by the wind vane), thereby adjusting the heading of the boat to maintain the desired heading relative to apparent wind in an automatic manner.

Referring now to the drawings.

Figures 1, 1A, 1B:
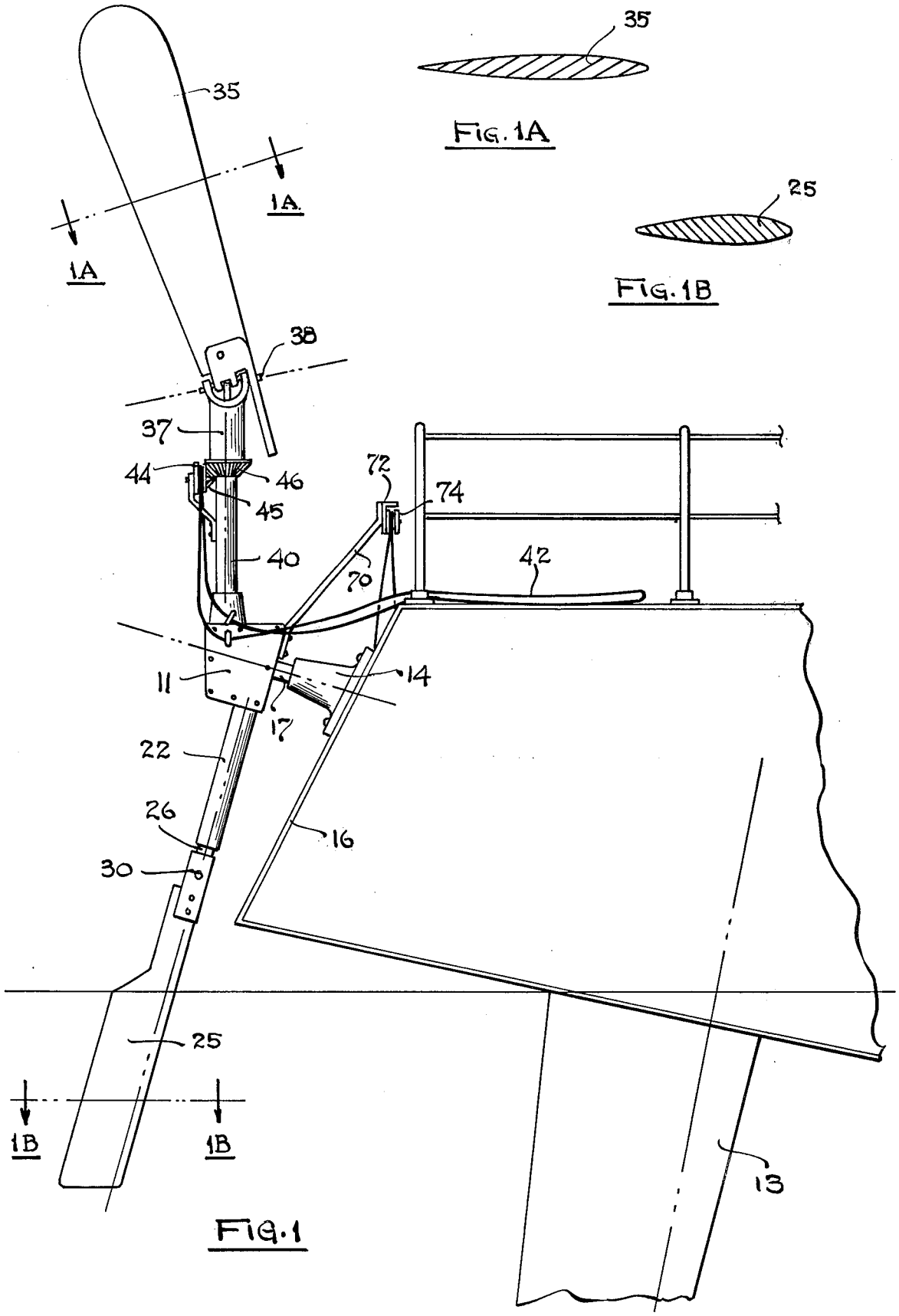
FIG. 1 is a side elevational view of a preferred embodiment of the invention showing one means for adjusting the rotational position of the wind vane.
FIG. 1A is a cross-sectional view taken along the plane indicated by 1A—1A in FIG. 1.
FIG. 1B is a cross-sectional view taken along the plane indicated by 1B—1B in FIG. 1.
Figure 2:
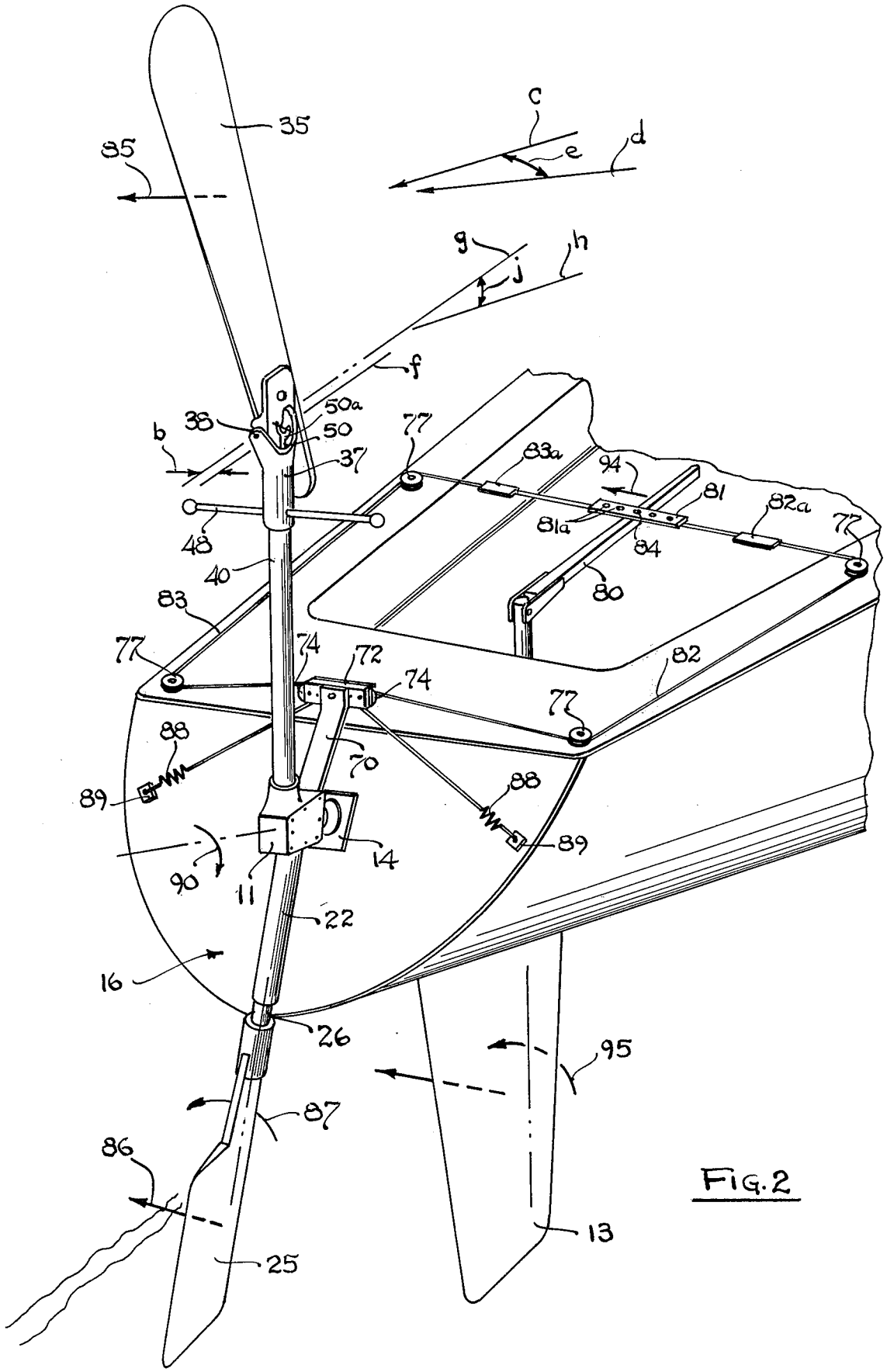
FIG. 2 is a perspective view showing the preferred embodiment of the invention with a second means for adjusting the rotational position of the wind vane.
Figures 3, 3A:
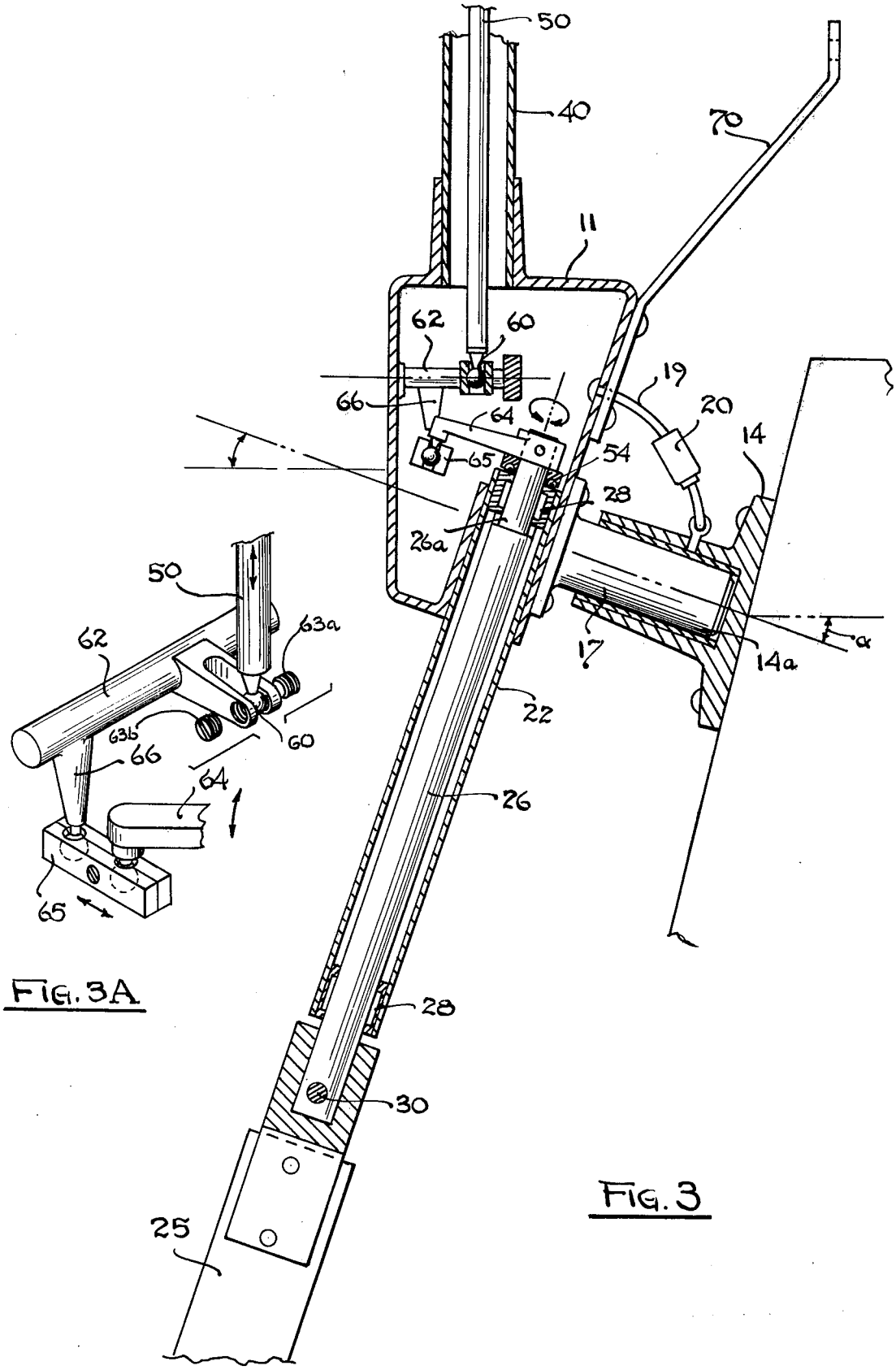
FIG. 3 is a cross-sectional view illustrating the details of the various mechanical couplings between the wind vane and the oar member in the assembly formed by these two members which is attached to the transom of the boat.
FIG. 3A is a perspective drawing showing the details of the coupling between the wind vane push rod and the oar shaft.

Referring now to FIGS. 1–3, a preferred embodiment of the invention is illustrated. It is to be noted that different types of mechanisms are shown in FIGS. 1 and 2 for setting the rotational position of the wind vane (for course selection), but otherwise the mechanizations shown are the same.

Center body 11 which also forms a "housing" (which may be closed as shown or may be open) is pivotally supported on bracket 14 which is fixedly attached to the transom 16 of a yacht. Such pivotal support is accomplished by means of shaft member 17 which is fixedly attached to the center body and which is supported for rotation in sleeve bearing 14*a* formed in bracket 14 (see FIG. 3). Center body 11 is prevented from being detached from bracket 14 by means of safety line 19 which has a spring member 20 incorporated therein to allow some play. Fixedly attached to housing 11 is tube member 22. Oar member 25 is fixedly attached to shaft 26, this shaft being rotatably mounted in tube member 22 on roller bearing 28 (see FIG. 3). A quick-release pin 30 is provided between oar 25 and shaft 26 to permit rapid and convenient separation of these two members.

Oar 25 is preferably shaped in the form of a symmetrical high-lift hydrodynamic foil which is hydrodynamically well-balanced, with the distance between the turning shaft centerline and the center of the hydrodynamic effort point being rather small, e.g. of the order of 20% of the foil cord length. For minimal turning friction, shaft 26 and tube 22 are made rather long, thereby affording a long bearing. The pivotal axis of shaft 17 runs in a generally longitudinal direction relative to the hull of the yacht. For proper stability, however, it is helpful if shaft 17 is angulated slightly downwardly from the horizontal line in the longitudinal center symmetry plane of the boat as indicated by the angle "$\alpha$" in FIG. 3. Typically, this angle should be 10°–20°.

Dual axis wind vane 35 is pivotally supported on mount 37 by means of pivot bearing pins 38 which are supported on ball bearings 38*a*. Mount 37 is supported for rotation of the vane on a rear vertical axis on tube 40 which in turn is rigidly attached to the center body. In the embodiment of FIG. 1, the rotational position of wind vane 35 is manually set by means of lines 42 which are coupled to block 44. Block 44 has a smaller bevel gear 45 in a friction-loaded attachment thereto which engages a mating larger bevel gear 46 attached to mount 37. In the embodiment of FIG. 2, the wind vane is set in the desired rotatable position relative to apparent wind by means of handle 48 with a friction rod inside the handle pushing against the fixed mast tube 40.

Figure 3B:
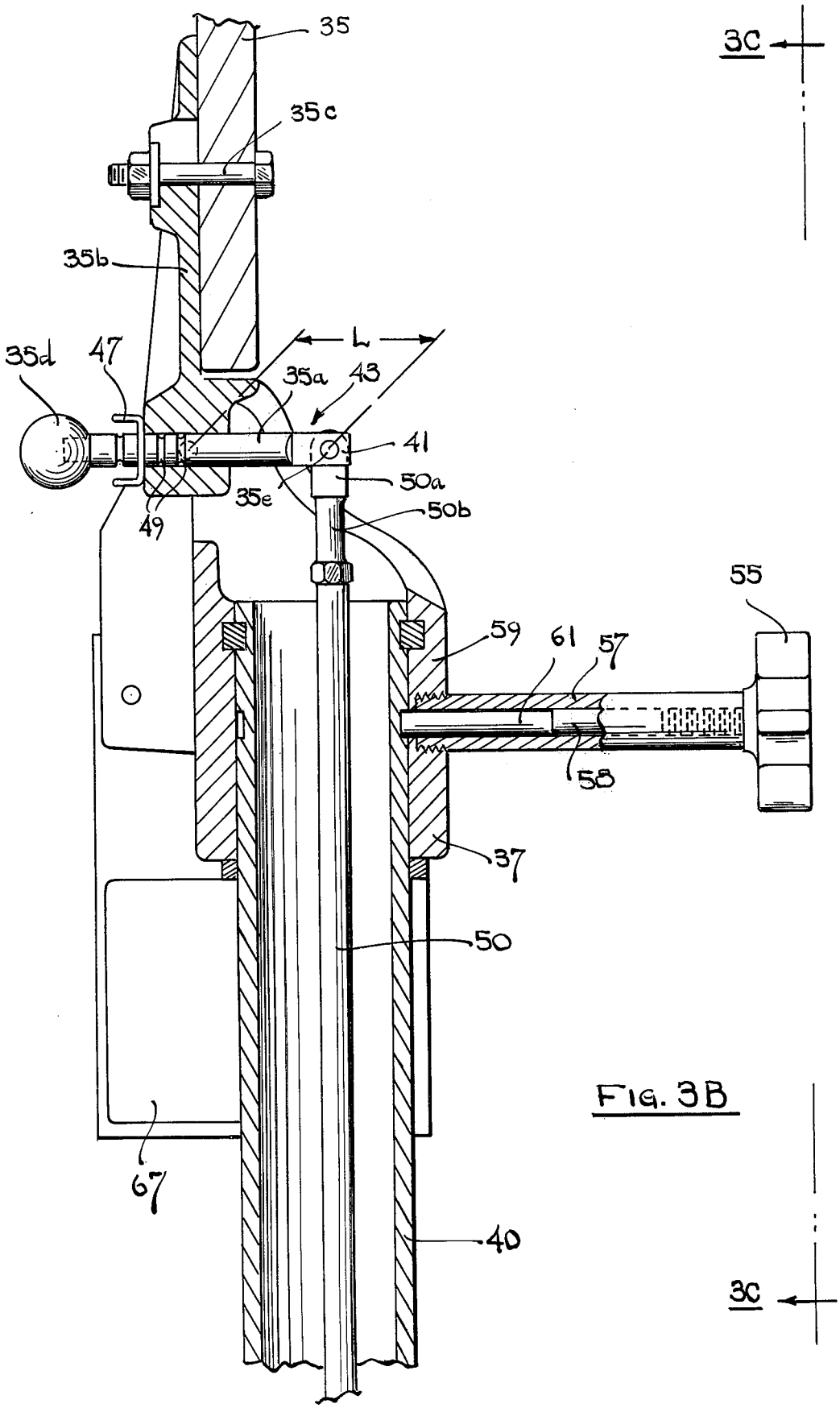
FIG. 3B is an elevational view in cross section showing the details of the coupling between the wind vane and the push rod.
Figure 3C:
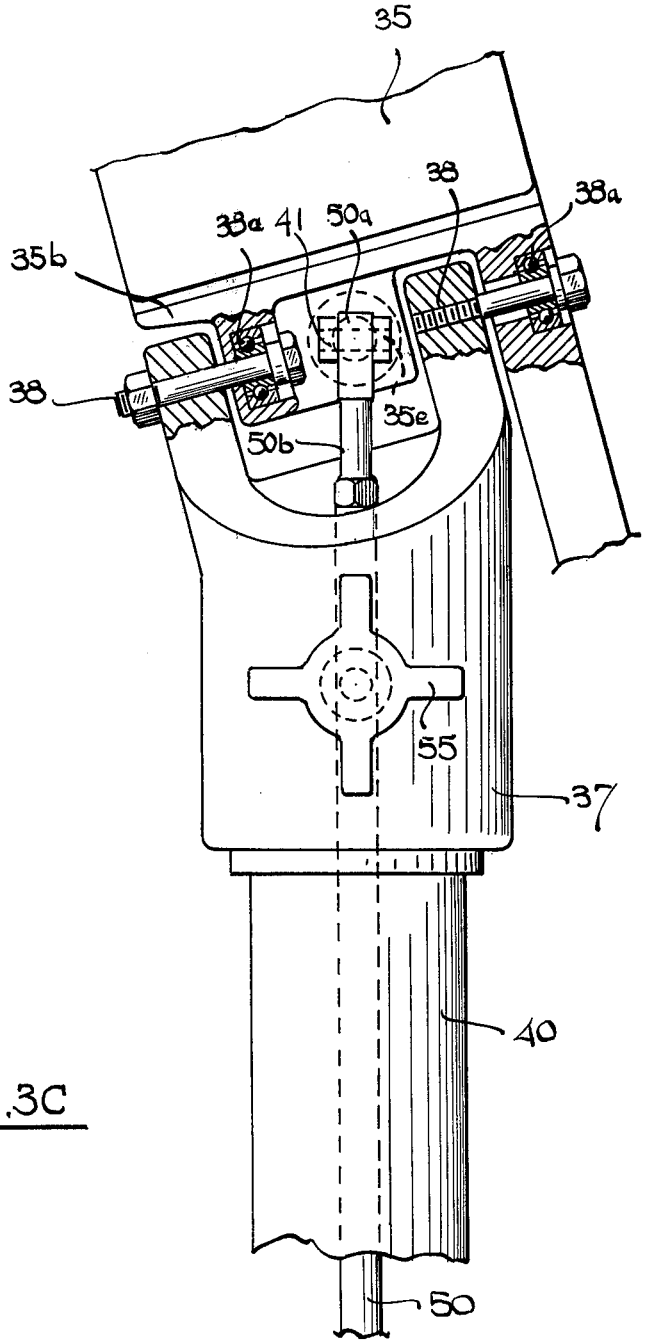
FIG. 3C is a view taken along the plane indicated by 3C—3C in FIG. 3B with partial sections cutaway.

As can best be seen in FIGS. 3B and 3C, wind vane 35 is coupled to the shaft 26 of oar 25 by means of a coupling mechanism including push rod 50 which runs through tube 40 to a variable-ratio mechanism 43 in the pivotal vane base 35*b*. Base 35*b* is attached to the vane 35 by means of bolt 35*c*. The top end 50*a* of push rod 50 is forked. This fork is engaged by a variable-length pin member 35*a* which extends from wind vane base plate 35*b*. The top end portion 26*a* (see FIG. 3) of shaft 26 has a ball bearing race 54 attached thereto to further facilitate low friction rotation of the shaft.

The end of push rod 50 is rotatable relative to the center body and is coupled through a spherical rod end 60 to a 90° rocker unit 62. Rod end 60 is seated in a spherical slot formed by spherically bottomed screw members 63*a* and 63*b*. The end portion 26*a* of shaft 26 is rigidly connected to a lever arm 64 and its spherical rod end which is connected by means of a linkage unit 65 (with two spherical seats) to rocker arm 66 of rocker unit 62. This friction-free mechanism is essentially the same as that described in connection with FIG. 3 of my aforementioned U.S. Pat. No. 3,983,831, and therefore will not be described in detail herein. It suffices to say that with the arrangement of vane base support as in FIG. 1, upward motion of the push rod results in counter-clockwise rotation of shaft 26 as viewed from above, and vice-versa. It can be seen that center body 11 not only provides support for the oar and wind vane base and for the mounting shaft for joining the assembly to bracket 14, but also provides a housing for the drive mechanism interconnecting push rod 50 and shaft 26.

Referring now particularly to FIG. 2, means incorporated in the preferred embodiment for coupling the oar-vane assembly to the tiller of a yacht is shown. Bracket 70 at one end is fixedly attached to center body 11 and, at the opposite end, has a block plate 72 supported thereon. Rotatably mounted on block plate 72 are a pair of blocks 74. Further, there are blocks 77 rotatably mounted on the deck of the boat. Attached to the tiller 80 is a trimming plate 81. Relatively non-elastic lines 82 and 83 are run around blocks 74 and 77 to the opposite ends of trimming plate 81 and are attached through springs 88 to retainer members 89 fixedly attached to the transom. A plurality of apertures 81*a* are provided in trimming plate 81 for selectively connecting this plate to pin 84 of the tiller so as to enable the lines to be trimmed relative to tiller 80. Weaker insert sections 82*a* and 83*a* are provided in lines 82 and 83 so that under heavy tension these lines will snap, and thus prevent damage to the components of the system and particularly avoid breakage of the oar or its shaft.

Means are provided for adjusting the positioning between pin 35*a* and fork 50*a* of the push rod for a range of adjustment indicated by "b" in FIG. 2. This permits a precise setting of the vane to oar ratio for optimum performance at conditions of different values for the ratio of dynamic pressures of wind and wake motions. By this adjustment, the distance between the fork axis "f" and the vane rotation axis "g", as shown in FIG. 2, can be adjusted.

Referring now to FIGS. 3B and 3C, the variable ratio coupling between the wind vane base and the push rod is illustrated. Pin member 35*a* is slidably supported in the base plate 35*b* of wind vane 35 and has a knob 35*d* on the outer end thereof. Pin member 35*a* is resiliently retained in position by means of locking spring 47 which is fixedly attached to vane base 35*b*. The distance between the longitudinal axes of the push rod 50 and the vane 35 is indicated by "L" in FIG. 3B. This distance can be adjusted by pulling knob 35*d* to set spring 47 in a selected one of slots 49, thereby changing the distance "L" to change the effective lever arm and thus the motion ratio between these two elements. Pin 35*e* fits through forked portion 50*a* of rod 50 and end portion 41 of pin member 35*a* to join these two members together. Rod 57 is attached to wall 59 of mount 37 which is attached to vane base 35*b*. Slidably mounted within rod 57 are a plunger 58 and a rod 61 made of a plastic material such as Delrin. Knob 55 is threadably attached to rod 57. When knob 55 is turned, rod 61 is tightened against tube 40 to retain the top portion of the tube to mount 37. Rod 50 has a portion 50*b* in the form of a screw which threadably engages forked portion 50*a*. This screw is used to adjust the effective length of the push rod as may be necessary. A counterbalance 67 is fixedly attached to tube 40 to counterbalance the force moment of the vane.

Vane 35 is inclined by an angle "j" relative to the horizontal projection line "h" as shown in FIG. 2. This inclination angle is typically of the order of 10°–20° upwardly (facing the wind). The reason for using this shaft inclination is for added stability and yaw damping, particularly when sailing with the wind from behind.

Referring now to FIG. 2, the typical operation of the system of the invention will be described. Let us assume that there has been a departure from the desired apparent wind vector "c" to a new direction "d" resulting in a error angle "e", as shown in FIG. 2. Under such circumstances, a wind force on vane 35 in the direction indicated by arrow 85 will occur. This will cause the vane to move pivotally on support pins (bearings) 38 in the direction indicated by arrow 85 so as to draw push rod 50 upwardly. Such upward motion of the push rod will result in a counter-clockwise rotation (as viewed from above) of the shaft 26 and oar 25 as indicated by arrow 87. This will result in a sidewise force on oar 25 by the water stream in the direction indicated by arrow 86. This results in a clockwise rotation of the center body 11 on the sleeve bearings of bracket 14 as indicated by the arrow 90. With its rotation, center body 11 carries along with it bracket 70 and block plate 72 which results in lines 82 and 83 being drawn so as to move trimming plate 81 and tiller 80 in the direction indicated by arrow 94. Such motion of the tiller in turn results in rotation of the boat's rudder 13 in the direction indicated by arrow 95 to bring the yacht to the desired course (with zero "error" angle).

It is to be noted that the entire wind vane-oar member assembly can be rapidly removed from the boat transom merely by unlatching attachment line 19 and disconnecting the block plate 72 from bracket 70. Conversely, the unit can be reinstalled just as simply by placing shaft 17 in the downward slanting sleeve bearing formed in bracket 14 and reconnecting the block and attachment line. It is further to be noted that in view of the fact that tube 40 is fixedly attached to center body (housing) 11, the vane base moves laterally with pendulous motion of the oar. As the oar only generally is permitted to swing a maximum of about 15° to each side of center position, such lateral motion of the vane does not affect its proper operation. In fact, this rigid connection between the oar and vane base gives added stability and desired increased yaw damping when sailing downwind, compared to a system with a vane base fixed relative to the transom.

Figures 4A, 4B, 4C:
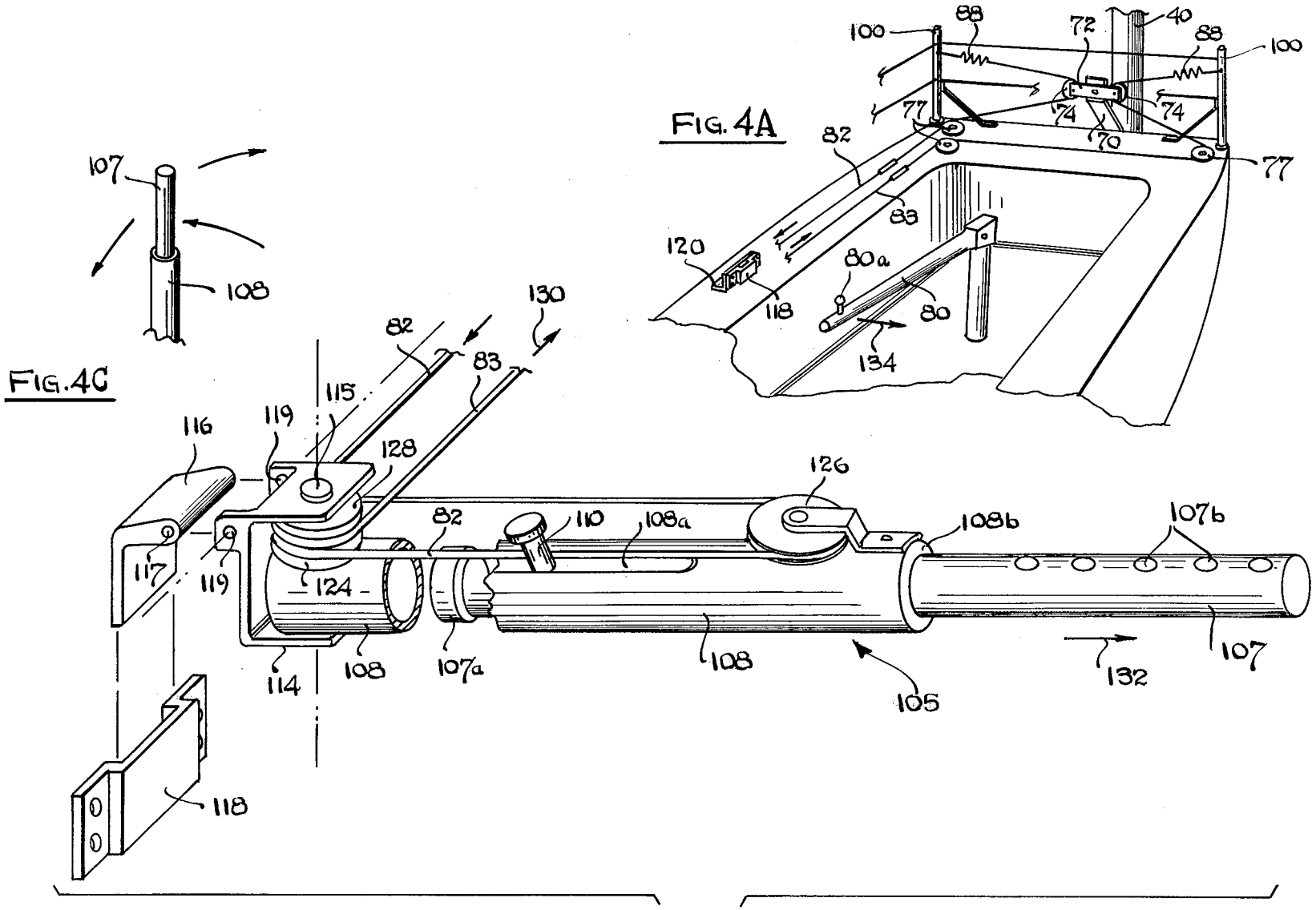
FIGS. 4A–4C are a series of drawings illustrating an alternative embodiment of a push rod line-driven coupling system which may be used between the oar-wind vane assembly and the tiller of a yacht.

Referring now to FIGS. 4A–4C, an alternative embodiment of a steering control system that may be employed in the invention is illustrated. In these figures, FIG. 4B is an enlarged exploded view of a push rod mechanism which connects to the yacht tiller 80 and is actuated by means of lines 82 and 83 which run around the blocks 74 of the block plate 72, as in the first described embodiment. Lines 82 and 83 are resiliently tensioned by means of springs 88 which are attached to stanchions 100. Lines 82 and 83 are run around and along blocks 77 as shown. The push rod mechanism 105 comprises a push rod 107 which is slidably supported in tubular member 108 which is shown broken away for convenience of illustration. Tubular member 108 has a slot 108*a* formed therein in which pin member 110 rides. Pin member 110 is fixedly attached to push rod 107 for slidable movement in the slot. Push rod 107 has a bushing 107*a* on one end thereof, and another similar bushing thereon (not shown), these bushings being of a low friction material such as Delrin and fitted within tubular member 108. Tubular member 108 is pivotally supported by means of pivot pin 115 for rotation about an axis in a plane essentially perpendicular to the lines 82 and 83 on U-bracket 114 which in turn is pivotally supported (for rotation about an axis in a plane essentially parallel to the lines 82 and 83) on L-bracket 116 by means of a pivot pin (not shown) which goes through apertures 117 and 119. L-bracket 116 is removably fitted within support bracket 118 and firmly retained therein by suitable means such as a hard rubber wedge member (not shown).

As can be seen in FIG. 4A, support bracket 118 is fixedly attached to L-plate 120 which in turn is fixedly attached to the yacht. Push rod 107 has a plurality of apertures 107*b* formed therein, the tiller having a spherical end rod 80*a* thereon which is fitted through a selected one of apertures 107*b*. The plurality of apertures 107*b* thus provides means for trimming the helm to the steering control mechanism as may be necessary.

Line 82 winds one-quarter turn (or one and one-quarter turns, two and one-quarter turns, three and one-quarter turns, etc.) around the lower block 124 with a center line coaxial with pin 115, and is fixedly attached to push rod attachment pin 110 from where it proceeds around block 126 and finally three-quarter turns (or one and three-quarter turns, two and three-quarter turns, three and three-quarter turns, etc.) around upper block 128 coaxial with and equal in diameter to block 124 from which it exits as line 83.

The control system operates as follows: Let us assume that line 83 is drawn in the direction indicated by arrow 130. This will cause push rod 107 to be drawn in the direction indicated by arrow 132 which in turn will cause tiller 80 to be driven in the direction indicated by arrow 134. When line 82 is drawn, it should be apparent that the reverse operation occurs, thus providing for the desired control of the tiller in response to pendulous motion of the oar. It is to be noted that in view of the fact that tubular member 108 is pivotally supported on U-bracket 114 and U-bracket 114 is pivotally supported on L-bracket 116, the push rod, when disconnected from tiller 80, can be rotated about two mutually perpendicular axes, i.e., the axis of the pivotal mounting between U-bracket 114 and L-bracket 116, and a pivotal mounting between tubular member 108 and U-bracket 114. Thus, without the need of slackening any of the lines, it is possible to rapidly and easily disconnect the push rod from the tiller and raise it upwardly, sidewise, or combinations of both, to any desired position to clear the cockpit as schematically illustrated in FIG. 4C for stowage, or should completely manual steering be desired, or should the oar or vane components not be mounted for operation.

Figure 5:
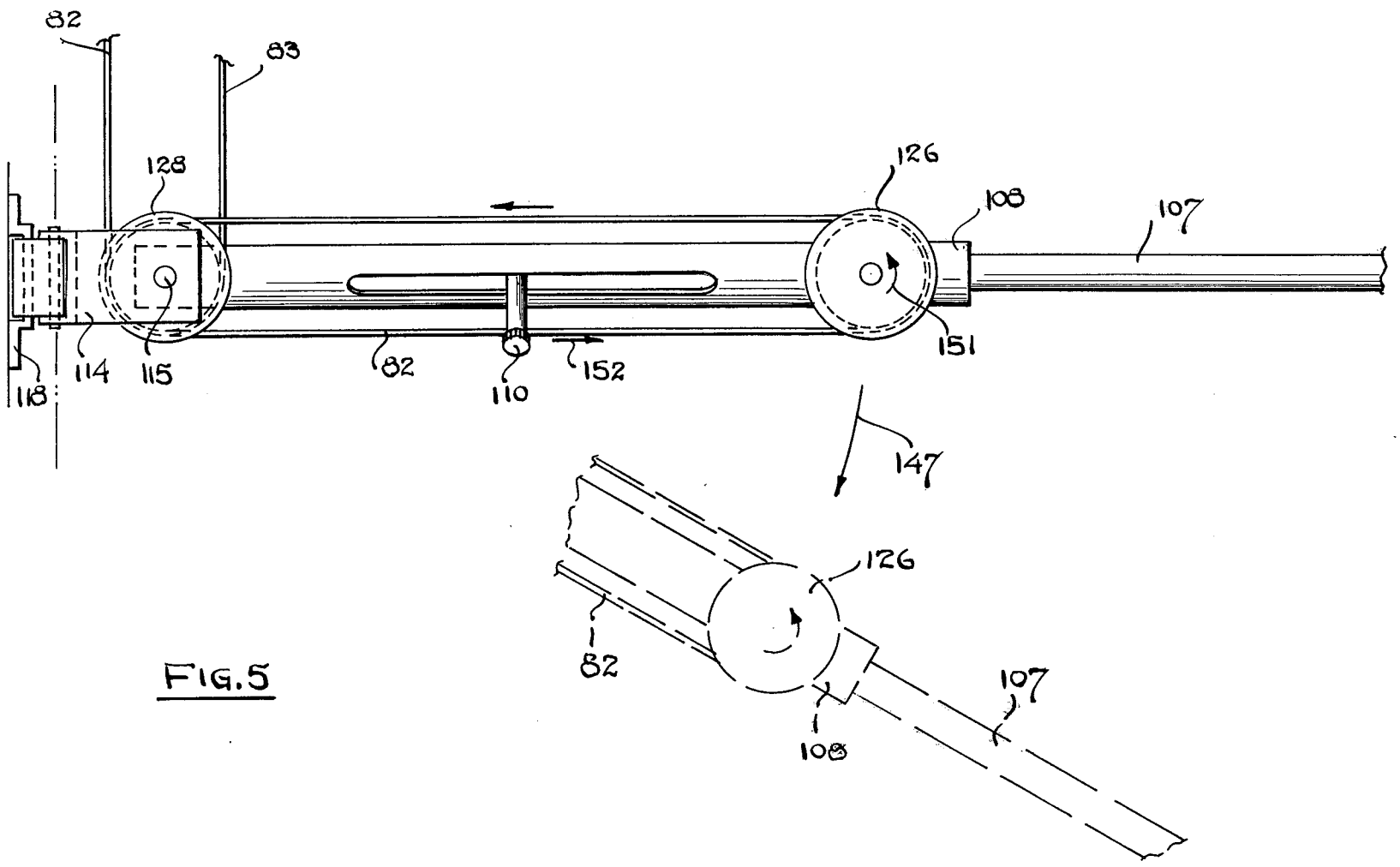
FIG. 5 is a schematic illustration showing line and push rod motions in the embodiment of FIGS. 4A–4C, with alternate push rod orientations.

FIG. 5 schematically illustrates how the lines are kept from slackening (or becoming too taut) as push rod 107 is rotated about the axis of pin 115. For the purposes of illustration, the push rod is shown being manually rotated in the direction indicated by arrow 147, with the lines 82 and 83 fixed. It is to be noted that such a rotation does not result in any rotation of blocks 124 and 128 relative to the yacht. The rotation of the push rod causes the line to roll up further on the upper block 128, and lesser on the lower block 124. Block 126 will rotate as shown by arrow 151, and the push rod is driven in the direction indicated by arrow 152. The system does not develop any slack in the lines during the described displacement of the rod.

Figure 6:
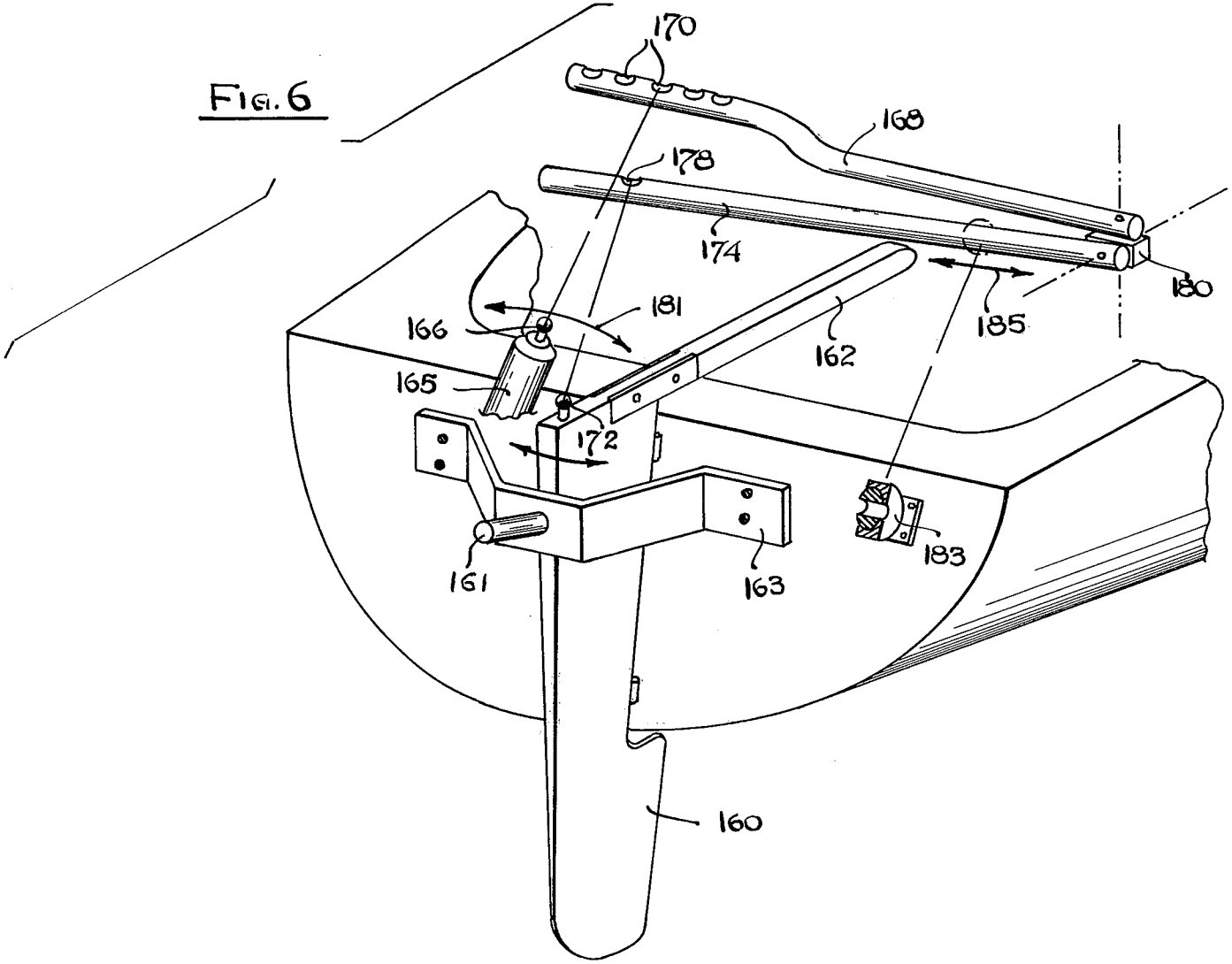
FIG. 6 is a perspective view of still another embodiment of the invention for use in connection with a yacht having an outside hung rudder.

Referring now to FIG. 6, a further mechanism for connecting the vane-oar mechanism to the tiller of a yacht is shown, this particular mechanization being suitable for use in a yacht having an outside hung rudder. The rudder 160 is hinged to the transom of the yacht and is operated by tiller 162. The center body 11 of the vane-oar assembly has a sleeve bearing attached thereto (not shown) which is used to pivotally support the assembly on pin member 161 which extends from bracket 163 attached to the transom of the boat and slants downward slightly, when viewed from behind. This of course is merely the inverse of the pivotal support employed in the other described embodiments where the shaft or pin was on the center body and the sleeve bearing therefor on the transom mounted bracket. Mounted on the center body 11 (not shown) is a post member 165 which has a spherical rod end knob 166. Rod 168 has a plurality of apertures 170 formed therein, one of which is selected to fit onto spherical rod end knob 166 so that it is connected to the center body of the oar-vane assembly.

Rod 174 is connected to the top of rudder 160 via knob 172, aperture 178 being fitted over the knob. Rod 168 is coupled to rod 174 via pivotal connecting linkage 180. In this system, the assembly can be rapidly and simply disconnected from the tiller merely by either removing rod 168 from spherical knob 166 or rod 174 from spherical knob 172. Rod 174 rides in a spherical bearing in sleeve 183 which is fixedly attached to the transom of the boat. It should be apparent that left and right pivotal motion of the center body, as indicated by the arrow 181, will cause a corresponding motion of rod 174 as indicated by arrow 185 with the desired coupling to the yacht's tiller 162.

Figure 7:
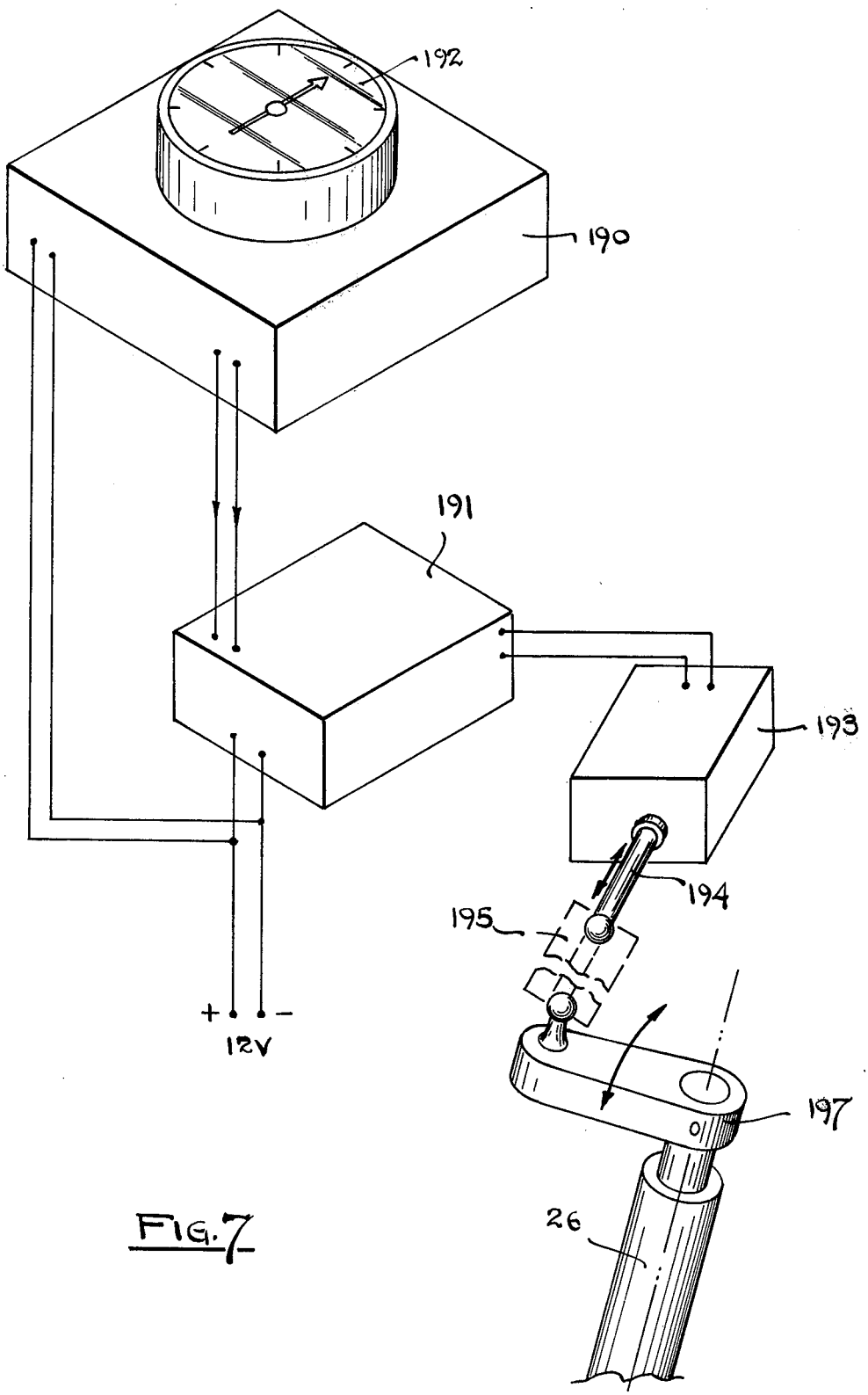
FIG. 7 illustrates a still further embodiment of the invention for use with an electrical compass and electric drive in lieu of the wind vane.

Referring now to FIG. 7, a further embodiment of the invention is illustrated in which the oar, rather than being driven by a wind vane, is electrically driven. Compass control unit 190 includes a compass 192, means for setting a desired course relative to compass course, and means for producing an error signal whenever the compass course deviates from desired course. The output of control unit 190 is fed to power amplifier unit 191. The output of power amplifier 191 drives electrical motor 193 which, in turn, drives a linear actuator 194. The linear actuator 14 is coupled through ball-rod linkage 195 to shaft arm 197 which in turn is coupled to the shaft 26 of the pendulous oar 26. Thus, the oar shaft 36 is rotatably driven whenever compass heading deviates from desired heading as set on the compass control unit 190, the oar shaft and its connecting linkage operating to control the yacht's rudder in the same basic manner as described in connection with the embodiments employing a wind vane. In this embodiment, linkage 195, motor 193, actuator 194 and arm 197 are mounted on a center body which is pivotally mounted on the transom as in the previous embodiments.

Figure 8:
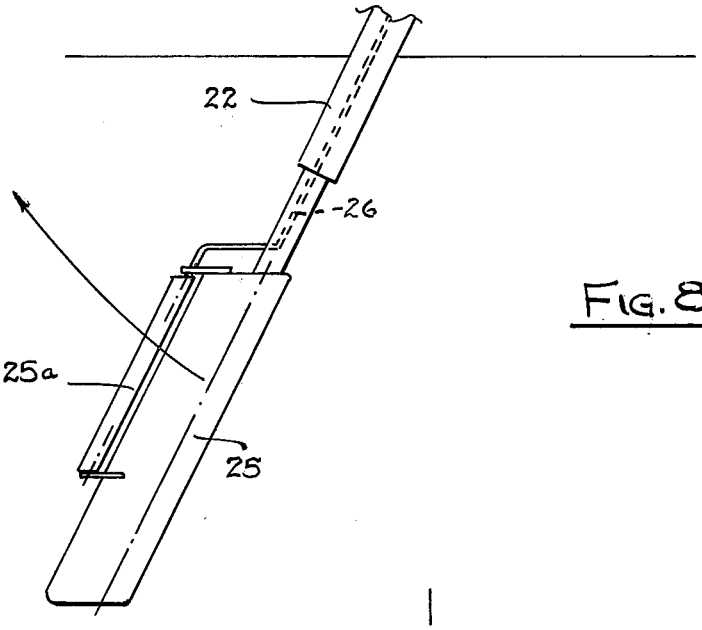
FIG. 8 is an elevational view illustrating an alternate configuration of the oar member which employs a trim tab.

Referring now to FIG. 8, a further embodiment of the invention is shown. This embodiment differs from that of FIG. 1 in that a trim tab **25*a* is pivotally mounted on the main oar 25. The trim tab is rotatably driven by a shaft arrangement 26 in lieu of the main oar which is pivotally supported on tube 22**. Thus, when the trim tab is rotated away from a position parallel to the main oar, the oar will be rotated in the opposite direction by the trim tab torque and driven sidewise by the water stream to effect the desired steering control. The use of trim tabs is well known in the art and fully described in the work by Dykstra cited earlier in the specification.

Figure 9:
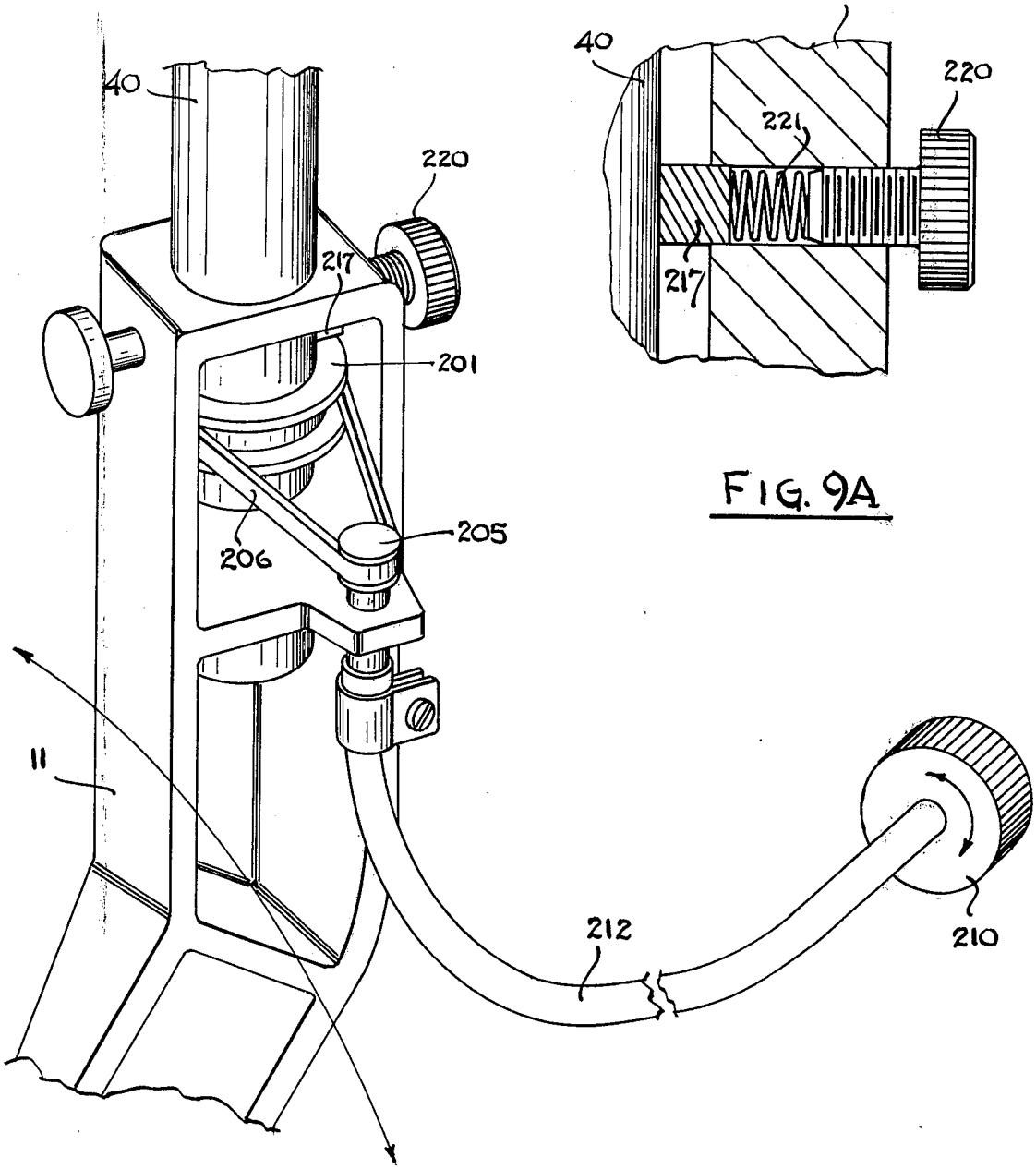
FIG. 9 is a perspective view of a mechanism which may be employed in the device of the invention for setting the position of the wind vane.
Figure 9A:
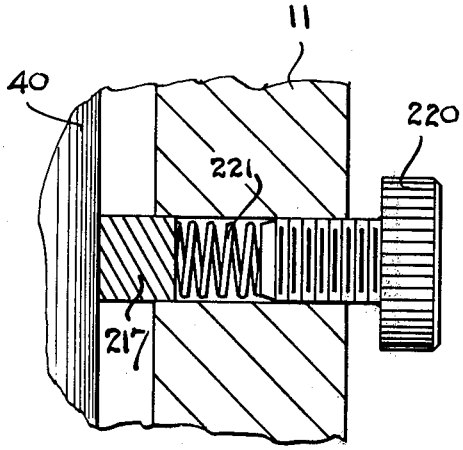
FIG. 9A is an elevational view in cross section of the wind vane retaining device of the mechanism of FIG. 9.
Figures 3, 3A:
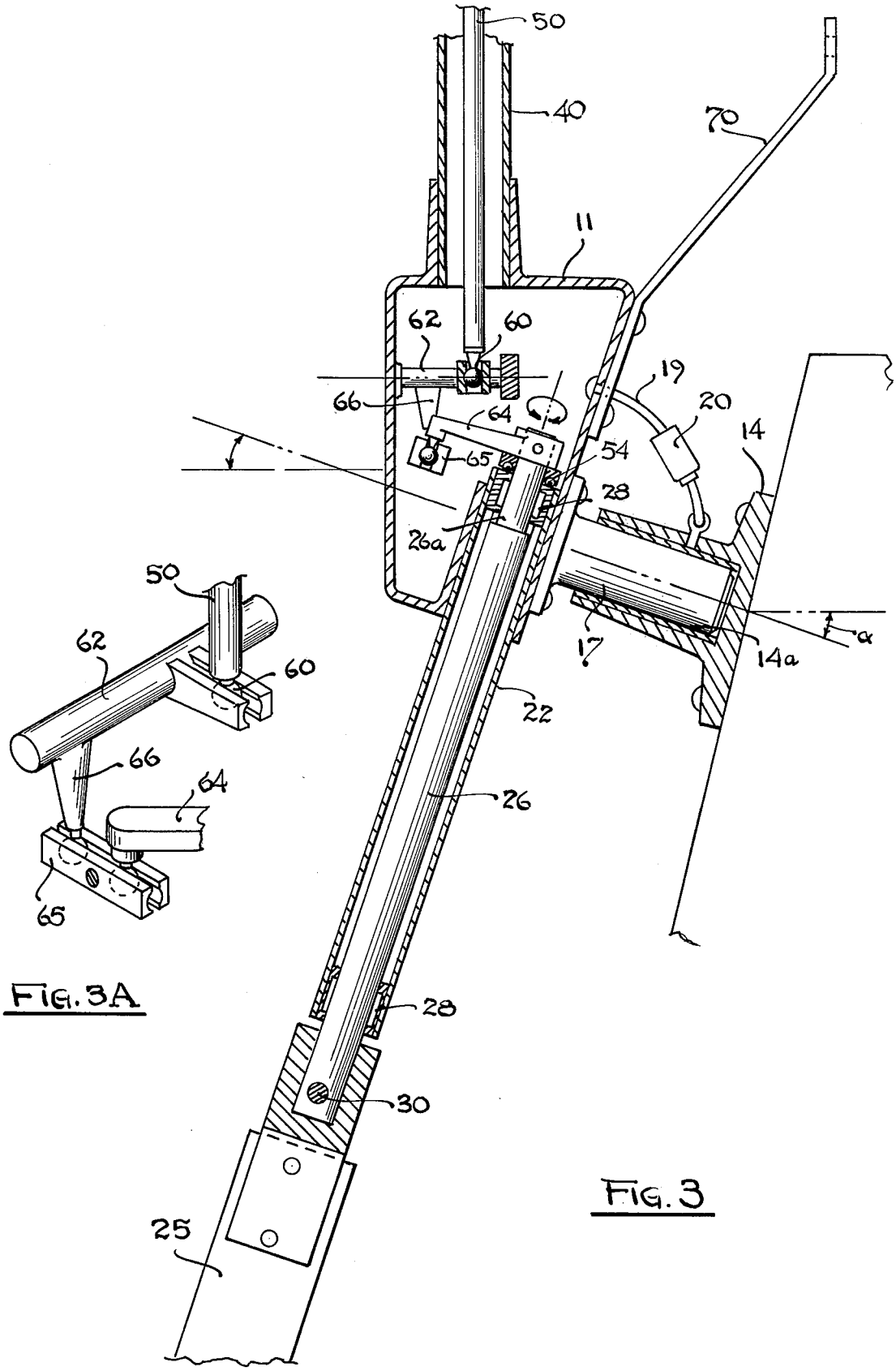

Referring now to FIGS. 9 and **9*a*, a mechanism for setting the angle of the wind vane from the helm is illustrated. Fixedly attached to rotatably supported vane support tube 40 is a pulley wheel 201. Pulley wheel 201 is coupled to smaller pulley wheel 205 by means of pulley 206. Control knob 210, which is typically located near the boat's helm, has a control cable 212 attached thereto, the control cable being attached at its opposite end to rotatably supported pulley wheel 205. As best shown in FIG. 9A, a spring-loaded friction pad 217 abuts against the roughened surface of tube 40 to retain the tube in position, once it is set, by means of the knob. The holding friction of the pad is adjustable by means of knob 220 which abuts against spring 221 which in turn abuts against the friction pad 217. Locking knob 218 may be used to more securely hold the tube 40** in position should need be, as for example, in rough weather.

Figure 10:
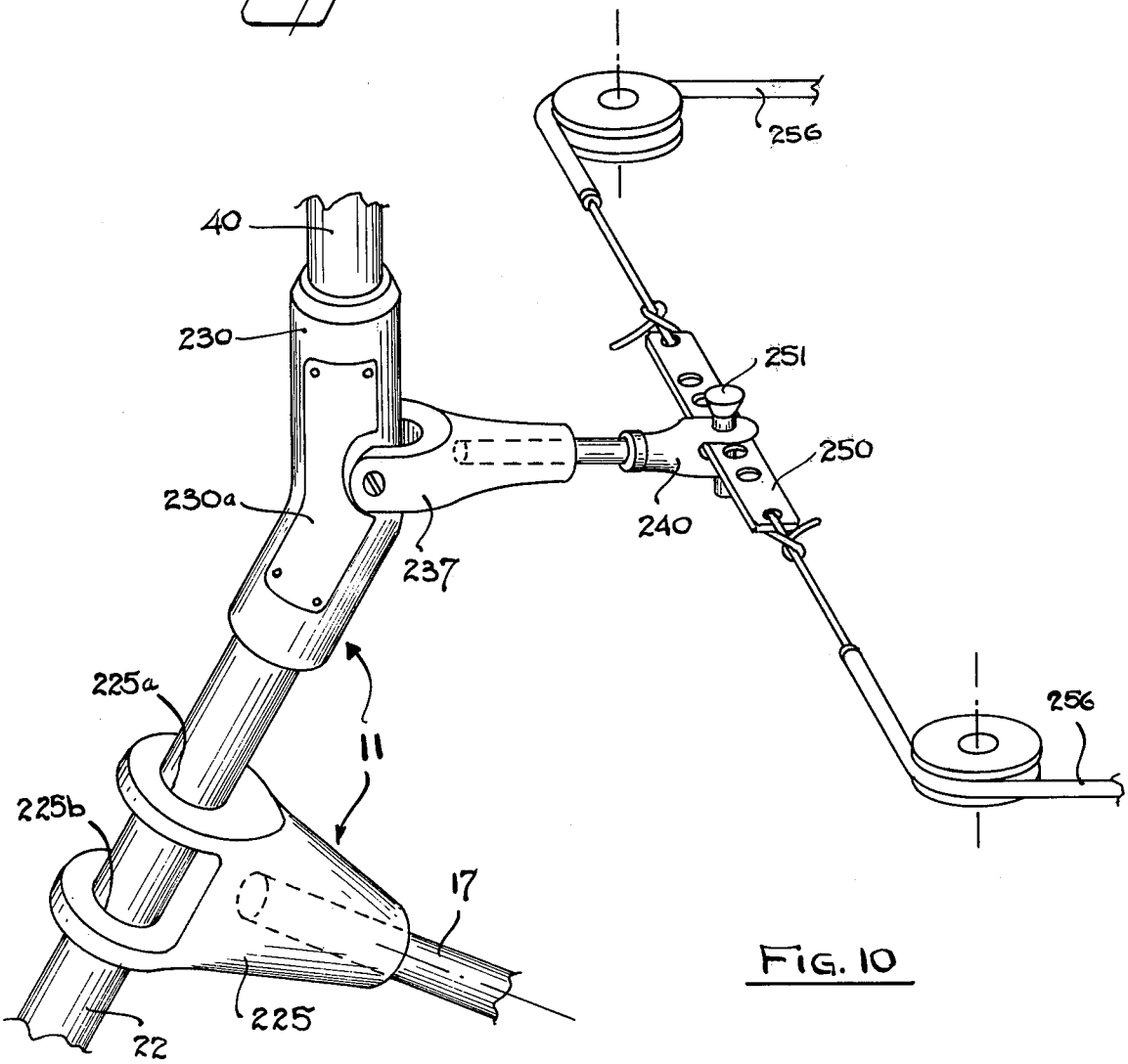
FIG. 10 is a perspective view of an alternative mechanism for supporting the oar and wind vane assembly of the invention on the transom of a boat and for coupling this assembly to the steering linkage of the boat.

Referring now to FIG. 10, an alternate configuration is illustrated for the pivotal support for the oar and vane assemblies and for coupling this assembly to the steering control of the boat. Pendulum shaft 17 which is pivotally supported on the transom of the boat as in the previous embodiments is fixedly attached to casting 225. Tube member 22 which supports the oar fits through apertures 225*a* and 225*b* formed in the casting and is fixedly attached to the oar. A housing 230 is placed between vane support tube member 40 and oar tube support member 22 and contains the coupling mechanism between the oar and the vane, access to which can be obtained through removable cover plate 230*a*. Pivotally mounted on housing 230 is arm member 237 which in turn has a fork member 240 which extends therefrom and is rotatably supported thereon. Fork member 240 is removably connected to connector plate 250 by means of quick release pin 251 which fits through the apertures in the arms of the fork member and a selected one of the apertures formed in plate 250. Plate 250 is connected to the steering control of the boat by means of cables 256 which may have weakened sections 256*a* therein as explained in connection with certain of the previous embodiments. It should be apparent that the casting 225 and housing 230 of the present embodiment form the center body 11 of the previous embodiments.

While the invention has been described and illustrated in detail, it is to be clearly understood that this is intended by way of illustration and example only and is not to be taken by way of limitation, the spirit and scope of this invention being limited only by the terms of the following claims.

I claim:

1. A system for self-steering a sailing craft to maintain a predetermined heading comprising:

a center body, means for supporting said center body on the boat for pivotal motion about an axis running in a generally longitudinal direction relative to the hull of said craft, an oar member, means for suspending said oar member from said center body in the water behind said craft, said oar member being suspended for rotational motion about an axis substantially normal to the pivotal axis of said center body, wind vane means for generating a mechanical displacement representing changes in the heading of the craft from a predetermined heading, rigid tube means fixedly attached to said center body at one end thereof and extending substantially upwardly therefrom for pivotally supporting said wind vane means on said center body for motion therewith about the pivotal axis of the center body, said wind vane means being supported on the other end of said tube means for pivotal motion about an axis running in a generally longitudinal direction relative to the hull of said craft, means for coupling the mechanical displacement output of said wind vane means to said oar member to rotatably drive said oar member in accordance with said mechanical displacement, the oar member being pendulously driven by the water stream when such rotation thereof occurs and pivotally driving the center body about its pivotal axis, said center body carrying said wind vane means along with it about said pivotal axis, and means for coupling said center body to the rudder of the craft whereby said rudder is driven in response to pivotal motion of the center body so as to maintain the heading of the boat on said predetermined heading.

2. The system of claim 1 and further including a push rod mounted in said tube member and reciprocally driven by said wind vane with pivotal motion thereof, and means for coupling said push rod to said oar member to convert the pivotal motion thereof to rotatable motion of said oar member.

3. The system of claim 2 further including means for adjusting the position of the vane rotatably relative to apparent wind including a support member for the vane mounted for rotatable positioning on the tube member, and means for rotatably positioning said support member relative to said tube member.

4. The system of claim 3 wherein the means for positioning the support member comprises a handle extending outward from said support member.

5. The system of claim 3 wherein said means for adjusting the position of said vane comprises a pair of bevel gears, one of which is mounted on said support means, the other of which is mounted on the tube member, a block fixedly attached to the other of said bevel gears and a line wound around said block.

6. The system of claim 2 wherein said center body forms a housing for the push rod-oar member coupling means.

7. The system of claim 2 and further including means for adjusting the coupling between the push rod and the wind vane to set the oar/vane movement ratio to an optimum value.

8. The system of claim 1 wherein said means for pivotally supporting the center body on the transom of said craft comprises a shaft extending from said center body and a bracket mounted on the transom of the craft having a sleeve bearing formed therein for receiving said shaft.

9. The system of claim 1 wherein the means for suspending the oar member from the center body comprises an elongated tube member fixedly attached to the center body and an elongated shaft rotatably supported in said tube member, the oar member being attached to one end of the shaft, the other end of the shaft being coupled to said means for generating a mechanical displacement signal.

10. The system of claim 1 wherein the craft has a tiller for controlling the rudder thereof and said means for coupling the center body to the rudder comprises a pair of cables attached at one of their ends to said tiller, and means for coupling said cables at the other ends thereof to said center body.

11. The system of claim 10 wherein the means for coupling said one ends of said cables to the center body comprises a bracket extending from said center body and means for rotatably supporting a pair of blocks on said bracket in spaced relationship to each other, each of said cables being wound around one of said blocks, and means for resiliently attaching one of the ends of each of said cables to the transom of said craft, and means for attaching the other of the ends of each of said cables to said tiller.

12. The system of claim 11 further including weakened sections in each of said cables which will part when the tension on said cables exceeds predetermined limits.

13. The self-steering system of claim 1 wherein said means for coupling the center body to the steering mechanism of the craft comprises a tube member, means for mounting said tube member on the craft for pivotal motion about two mutually orthogonal axes, a push rod slidably mounted in said tube member, means for connecting the push rod to the steering mechanism of the craft, first and second lines, means for coupling said lines to said center body, and means for coupling said lines to said push rod, whereby pendulous motion of said oar member and pivotal motion of the center body actuates said lines so as to linearly drive the push rod resulting in actuation of the craft steering mechanism.

14. The system of claim 13 wherein the means for coupling said lines between the center body and the push rod comprises a series of blocks mounted on the center body, on the hull of the craft and on the tube member, around which the lines are wound.

15. The system of claim 1 wherein the means for coupling the craft rudder to said center body comprises a post member fixedly attached to said center body, a tiller for positioning the rudder and rod means interconnecting the post member and the tiller.

16. The system of claim 15 wherein the rod means comprises a pair of rods pivotally connected at one end thereof, the other end of one of said rods being removably attached to said post, the other end of the other of said rods being removably attached to said rudder.

17. The system of claim 1 wherein the means for coupling the center body to the rudder of the craft comprises a first member pivotally attached to the center body, a second member rotatably attached to said first member and extending therefrom, cable means for controlling the position of the rudder, and quick-release means for removably connecting said second member to said cable.

18. The system of claim 17 wherein said second member has a forked apertured end portion, said quick-release means comprising an apertured connector plate connected to said cable and a pin member fitted through the apertures of said forked end portion and said connector plate so as to interconnect said second member and said connector plate.

19. The system of claim 1 wherein said oar member comprises a trim tab, the displacement generating means on the center body being coupled to said trim tab to rotatably drive said tab.

20. The system of claim 1 and further including means for setting said wind vane in a predesired position relative to apparent wind comprising pulley means coupled to said tube member and cable means for rotatably driving said pulley means to effect rotation of said tube member to said predesired position.

* * * * *